United States Patent [19]

Soecknick et al.

[11] 4,332,143

[45] Jun. 1, 1982

[54] DEVICE FOR COOLING A GAS TO BELOW ITS DEW POINT

[75] Inventors: Erhard Soecknick, Erkrath; Jürgen Busse, Mönchengladbach, both of Fed. Rep. of Germany

[73] Assignee: Messer Griesheim GmbH, Frankfurt am Main, Fed. Rep. of Germany

[21] Appl. No.: 114,269

[22] Filed: Jan. 22, 1980

[30] Foreign Application Priority Data

Feb. 1, 1979 [DE] Fed. Rep. of Germany ... 7902672[U]

[51] Int. Cl.[3] ..... F25D 21/06

[52] U.S. Cl. ..... 62/284; 62/93; 62/52; 62/63; 165/94

[58] Field of Search ..... 62/93, 303, 63, 384, 62/52, 284; 165/94; 55/269; 259/16 F; 15/104.1 X, 246.5

[56] References Cited

U.S. PATENT DOCUMENTS 3,106,070 10/1963 Harper et al. ..... 62/52 X 3,848,624 11/1974 Banike ..... 62/384 X 3,973,623 8/1976 Sarll ..... 165/94

4,212,171 7/1980 Soecknick ..... 62/63

4,242,110 12/1980 Hynes ..... 62/93

FOREIGN PATENT DOCUMENTS 2067729 8/1971 France ..... 165/94

*Primary Examiner*—William E. Wayner

*Assistant Examiner*—Henry Bennett

*Attorney, Agent, or Firm*—Connolly and Hutz

[57] ABSTRACT

A device for cooling a gas to below its dew point by heat exchange with a low-boiling gas includes a double-walled cooling pipe with an annular space between the walls having an inlet for the low-boiling liquefied gas and a drain pipe for the evaporated gas, with at least one blow-in opening for the low-boiling liquefield gas being in the zone of the intake opening of the cooling pipe; a movable ice scraper is arranged at the intake opening and is periodically movable over the blow-in opening for the low-boiling liquefied gas.

3 Claims, 1 Drawing Figure

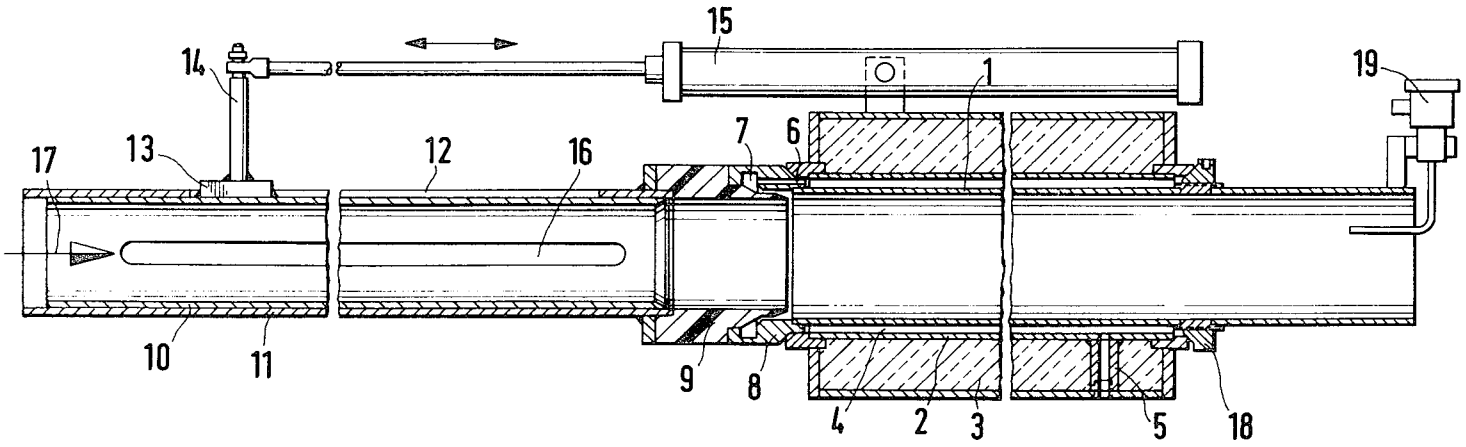
19
18
5
1
3
2
4
6
7
8
15
9
16
12
11
14
13
10
17

DEVICE FOR COOLING A GAS TO BELOW ITS DEW POINT

BACKGROUND OF THE INVENTION

The present invention concerns a device for cooling a gas to below its dew point by heat exchange with a low boiling liquefied gas.

Non-dried gases can be cooled only to above their dew points, because if the temperature drops to below the dew point, the moisture separates in the form of ice and clogs the pipes. This applies especially to the cooling of air, which is needed as a cooling agent for many industrial processes, e.g. in the manufacture of plastic film tubing, or for cooling profile bands. If ice formation is to be avoided, the air must be pre-dried, which is very expensive.

Thus, for example, a device for cooling endless profiles, which is known from the German Gebrauchsmuster No. 77 31 245, and which consists basically of a double-walled cooling pipe, in whose annular space a low-boiling liquefied gas evaporates and flows into the inside of the pipe, can also be used to cool a warm gas, but only to the dew point. If the temperature decreases to below the dew point, the pipe cross section in the zone of the inflow opening for the low-boiling liquefied gas becomes plugged with ice.

SUMMARY OF INVENTION

The object of the invention is to create a device of the above type, with which it is also possible to cool a gas to below its dew point without the risk of icing the cooling pipe cross section.

A device has now been found, according to the invention, for cooling a gas to below its dew point by heat exchange with a low-boiling liquefied gas, consisting basically of a double-walled cooling pipe whose annular space has a pipe connection for admission of the low-boiling liquefied gas and a drain pipe for evaporated low-boiling liquefied gas, which is in connection with at least one blow-in opening for the low-boiling liquefied gas in the zone of the intake opening of the cooling pipe. A movable ice scraper is arranged in the device according to the present invention at the intake opening of the cooling pipe with the ice scraper being periodically movable over the blow-in opening for the evaporated low-boiling liquefied gas.

If the blow-in opening is in the form of a ring nozzle covering the entire circumference, the ice scraper is preferably designed in the shape of a cylindrical pipe movable in an axial direction. The pipe is then pushed periodically for a short time over the blow-in opening, whereby the ice, which has formed meanwhile, is knocked off. The ice knocked off is entrained by the cooled gas stream and remains in same unless it is inconvenient. If so, it is separated.

If, however, only one or only a few nozzle openings, distributed over the circumference, serve as blow-in openings, the ice scraper can also be in the form of a rotatable cylindrical pipe, which has cut-outs or holes in the zone of the nozzle openings, which are non-overlapping with the nozzle openings during the blow-in of the evaporated low-boiling liquefied gas. To remove the ice, the ice scraper is turned through a certain angle, so that the nozzle openings become closed. This design is less advantageous, however, inasmuch as the ice scraper remains steadily in the zone of ice formation, i.e., there is a possibility that ice deposits will be formed on the ice scraper as well.

The periodic movement of the ice scraper can be effected by known means. The movement is preferably generated pneumatically, because a pneumatic cylinder is simple and inexpensive and compressed air is available in most cases.

THE DRAWINGS

The single FIGURE illustrates a longitudinal section of one example of the present invention, in which the periodic movement of the ice scraper is in the axial direction.

DETAILED DESCRIPTION

The double-walled cooling pipe of the device is formed by the inner pipe 1 and the outer pipe 2, which is enveloped in an insulation 3. The annular space 4 formed between the inner pipe 1 and the outer pipe 2 is partially filled with liquid nitrogen, which is supplied through the connection pipe 5. The evaporated nitrogen leaves the annular space 4 via the drain pipe 6 and enters the ring nozzle 7. The ring nozzle 7 is formed basically of two annular nibs 8 and 9. From the ring nozzle 7 the evaporated nitrogen exits at high velocity into the inside of the cooling pipe and is mixed with the air to be cooled, which is blown into the cooling pipe by means of a blower.

In the inside of the inner pipe 1 there is convective and radiant heat transfer, whereby the air, which is already cooled by mixing with the cold evaporated nitrogen, is cooled further, and the liquid nitrogen is evaporated in the annular space 4.

The most intense cooling takes place, however, at the site of entry of the cold evaporated nitrogen in the zone of the ring nozzle 7. Here, the temperatures of the air drops to below its dew point, and it is mainly here that a rapid icing begins. According to the present invention, the ice formed is removed by a periodically movable ice scraper.

The ice scraper consists of a cylindrical ejecting pipe 10, which is installed movably in a guide tube 11. The guide tube 11 is rigidly connected to the annular nib 9. In the guide tube 11, there is a slot 12, in which is mounted a sliding guide piece 13 attached to the ejecting pipe 10. Welded to the guide piece 13 is a rod 14 which is connected to a pneumatic cylinder 15. In the ejecting pipe 10 there is also the slit 16 which serves the purpose of allowing an outflow of the liquid nitrogen from the ring nozzle 7 into the interior of the cooling pipe during the lifting motion of the ejecting pipe 10.

The arrow 17 shows the entry of the air to be cooled into the device. The threaded ring member 18 allows one to dismantle the inner pipe 1 and the outer pipe 2 starting at the outlet side. By means of the temperature sensor 19, the supply of liquid nitrogen is regulated according to the temperature. This is not illustrated in detail. In order to avoid the conduction of cold to the ejecting pipe 10, it is advantageous to make the annular nib 9 from a material which is a poor heat conductor.

If ice has built up in the vicinity of the ring nozzle 7, the ejecting pipe 10 is slid out by the pneumatic cylinder past the outlet orifice of the ring nozzle 7. The ice is thereby scraped off and is pulled along by the air flow. If desired, it can be separated, in know fashion, from the air flow. This is, however, not required for most applications.

The ejecting pipe 10 is then slid back to its starting position by the pneumatic cylinder 15. The frequency of the periodic lifting motion of the ejecting pipe 10 depends upon the magnitude of the ice formation. According to an actual practice of the invention, the scraping off of the ice took place approximately every three minutes.

What is claimed is:

1. In a device for cooling a gas to below its dew point by heat exchange with a low-boiling liquefied gas wherein said device includes an inner pipe, an outer pipe surrounding said inner pipe and spaced therefrom to form an annular space therebetween, means for feeding the liquefied gas into the annular space for cooling the gas flowing through the inner pipe, an annular nozzle connected to said inner pipe in flow communication therewith, said annular nozzle and said inner pipe having substantially the same inner diameter, and means for feeding the gas through said nozzle and into said inner pipe for cooling the gas before it is discharged from said inner pipe, the improvement being a drain passage leading from said annular space to said inner pipe in the general area of the connection of said nozzle to said inner pipe whereby evaporated liquefied gas may be drained from said annular space and mixed with the gas flowing through said nozzle to further cool the gas, scraper means located in said nozzle at said area of connection with said inner pipe, said scraper means being positioned against the inner surface of said nozzle, and means for reciprocating said scraper means in a longitudinal direction back and forth across the outlet of said drain passage to prevent the build-up of ice thereat.

2. Device according to claim 1, characterized in that said scraper means is a cylindrical pipe movable in its axial direction.

3. Device according to claim 2, characterized in said means for reciprocating said scraper means is a pneumatic unit.

* * * * *